United States Patent [19]

Matsumoto et al.

[11] 4,444,015

[45] Apr. 24, 1984

[54] METHOD FOR RECOVERING POWER ACCORDING TO A CASCADED RANKINE CYCLE BY GASIFYING LIQUEFIED NATURAL GAS AND UTILIZING THE COLD POTENTIAL

[75] Inventors: Osamu Matsumoto, Inagi; Ichizo Aoki, Yokohama, both of Japan

[73] Assignee: Chiyoda Chemical Engineering & Construction Co., Ltd., Japan

[21] Appl. No.: 228,921

[22] Filed: Jan. 27, 1981

[51] Int. Cl.[3] ..... F01K 23/04; F01K 25/06

[52] U.S. Cl. ..... 60/648; 60/641.1; 60/651; 60/655; 60/671

[58] Field of Search ..... 60/648, 655, 651, 671, 60/641.1

[56] References Cited

U.S. PATENT DOCUMENTS

| | | | |
|---|---|---|---|
| 3,892,103 | 7/1975 | Antonelli | 60/648 X |
| 4,231,226 | 11/1980 | Griepentrog | 60/648 |
| 4,242,870 | 1/1981 | Searingen et al. | 60/651 |
| 4,400,947 | 8/1983 | Ruhemann | 60/648 |

FOREIGN PATENT DOCUMENTS

| | | | |
|---|---|---|---|
| 2604304 | 8/1977 | Fed. Rep. of Germany . | |
| 49-17401 | 2/1974 | Japan . | |
| 53-126003 | 2/1978 | Japan . | |
| 55-123306 | 9/1980 | Japan | 60/648 |
| 55-146209 | 11/1980 | Japan | 60/648 |
| 465802 | 5/1937 | United Kingdom | 60/671 |
| 904489 | 8/1962 | United Kingdom . | |

OTHER PUBLICATIONS

46209 W., *Chemical Abstracts,* vol. 82, No. 8, Feb. 24, 1975.

*Primary Examiner*—Sheldon J. Richter

*Attorney, Agent, or Firm*—Lowe, King, Price & Becker

[57] ABSTRACT

The present invention discloses a method for recovering effective energy as power between liquefied natural gas and a high temperature source by cascading two kinds of Rankine cycles when the liquefied natural gas is re-gasified. The method is characterized in that a first medium performs a first Rankine cycle with the liquefied natural gas as a low temperature source, the first medium being mainly a mixture of hydrocarbons having 1–6 carbon atoms or a mixture of halogenated hydrocarbons of boiling points close to those of said hydrocarbons, the first medium having compositions according to which the vapor curve of gasifying the liquefied natural gas substantially corresponds to the low pressure cooling curve of the first medium, the power generated thereby is recovered by a first turbine during the first Rankine cycle, a second medium having a higher boiling point than said first medium performs a second Rankine cycle with part of said first Rankine cycle as the low temperature source, the second medium, being a single hydrocarbon component having 1–6 carbon atoms or a mixture thereof, a single halogenated hydrocarbon whose boiling point is close to that of this hydrocarbon or a mixture thereof, or ammonia, whose low pressure cooling curve substantially corresponds to the vapor curve of the high pressure first medium, said first and second Rankine cycles are cascaded, and a second turbine is disposed to recover power during the second Rankine cycle.

7 Claims, 4 Drawing Figures

METHOD FOR RECOVERING POWER ACCORDING TO A CASCADED RANKINE CYCLE BY GASIFYING LIQUEFIED NATURAL GAS AND UTILIZING THE COLD POTENTIAL

SUMMARY OF THE INVENTION

The present invention relates to a method for recovering effective energy for power between a liquefied natural gas (to be referred to as hereinafter as LNG) and a high temperature source fluid by cascading two kinds of Rankine cycles in the process of re-gasification of the LNG.

Since LNG has received attention as being non-polluting, the amount of LNG introduced domestically has grown to 10 million tons per year. It is known that LNG is stored in the liquid phase at a temperature of −160° C. When LNG is used as fuel for generating electricity or as city gas fuel, the pressure of the LNG is increased to a predetermined value and the LNG is re-gasified at ordinary temperature by a certain method. In this re-gasification of the LNG, about 20 million kilocalories are required to gasify 100 tons of LNG. Conventionally, a method for re-gasifying LNG uses an open-rack type vaporizer whose heating source is sea water. In this case, the cold potential of the LNG has not been utilized, but only wasted and lost to the sea. Therefore, from the viewpoint of energy saving, methods for recovering effective energy for power from the cold potential of the LNG have recently been developed.

The methods are as follows:

(1) A method for recovering power in which the LNG is gasified through a medium of a single component such as propane, incorporating the Rankine cycle of the single component medium using sea water as the high temperature source (Japanese Laid-Open Patent Publication No. 126,003/1978);

(2) A method for recovering power in which the LNG is gasified through a mixture of nitrogen and light hydrocarbons as a medium, incorporating the Rankine cycle of the mixed medium (Japanese Laid-Open Patent Publication No. 17,401/1974);

(3) A method for recovering power in which the LNG pressure is increased to a high pressure, the LNG is gasified by sea water or the like, and its pressure is decreased to a predetermined pressure by a turbine;

(4) A method for recovering power by the Brayton cycle in which nitrogen is the heat medium, the LNG is the low temperature source, and part of the re-gasified LNG is burnt to be the high temperature source, and (5) A method for recovering power by the open gas turbine method in which air is the heat medium, the LNG is the low temperature source, and part of the re-gasified LNG is burnt to be the high temperature source.

In methods (4) and (5), the output power is great from the viewpoint of a generator. However, from the viewpoint of energy saving, these methods are not always advantageous, because a part of the re-gasified LNG is used as combustion gas fuel for the high temperature source, which entails self-energy consumption. To the contrary, in methods (1), (2) and (3), sea water or the like is used as the high temperature source and so self-energy consumption is not required. Thus, from the overall viewpoint of energy savings, methods (1), (2) and (3) are superior to methods (4) and (5). It is important for methods (1) to (3) to minimize the effective energy loss accompanying the heat exchanges between the LNG and the heat medium and between the sea water and the heat medium. This is accomplished by minimizing the temperature difference in each heat exchange. Therefore, in method (1), multi-stepped procedures must be used for decreasing the temperature difference in the heat exchange between the heat medium and the LNG as shown in FIG. 1, since the heat medium is of a single component. Thus, this method is disadvantageous due to high cost. In the direct expansion method (3), the LNG must directly exchange heat with the sea water, that is, the high temperature source fluid, so the temperature difference is great and the effective heat loss is great. Thus, this method is also not effective. On the other hand, in method (2), the temperature difference between the LNG and the heat medium can be kept small by adjusting the composition of the mixed heat medium. Thus, the effective energy loss can be reduced. The T-Q curve according to method (2) is shown in FIG. 2. An unrecovered portion of the effective energy shown by the cross-hatched portion of the figure is present in the heat exchange between the sea water as the high temperature source and the mixed heat medium since it is the heat exchange between the LNG and the mixed heat medium which is the primary consideration.

The present invention eliminates the above-mentioned problems and provides an improved method, particularly of method (2). A second Rankine cycle of a second heat medium is formed in the cross-hatched portion between the high temperature source and the mixed heat medium as shown in FIG. 2. Heat is exchanged between the high pressure mixed medium and the low pressure second medium, that is, the respective Rankine cycles of the respective media are cascaded, so that the effective energy loss is decreased and the power recovery is increased.

In the cascading process, the LNG together with the high pressure first mixed medium is heated by the low pressure first mixed medium, and further heated by the low pressure second medium at the multi-fluid heat exchanger.

The heat medium composition of the first Rankine cycle varies, depending on the composition of the LNG to be gasified, its gasification temperature, its pressure, and the temperature of the sea water as the external high temperature source. The overall cost performance is taken into consideration so as to select the temperature difference between the LNG and the first heat medium at the heat exchanger in the range of about 3°–10° C. throughout the process. The heat medium composition of the second Rankine cycle is determined with consideration of economy to maximize the power generated by the turbine of the second Rankine cycle, depending on the composition of the heat medium of the first Rankine cycle determined according to the above, the vapor pressure thereof, and the temperature condition of the external high temperature source.

One of the factors for selecting the components constituting each heat medium is whether or not the components may be prepared and are readily available at a plant site.

DETAILED DESCRIPTION OF THE PREFERRED EMBODIMENT

An embodiment of the present invention will be described in detail with reference to FIG. 3. However, the present invention is not restricted to this embodiment.

Figure 1:
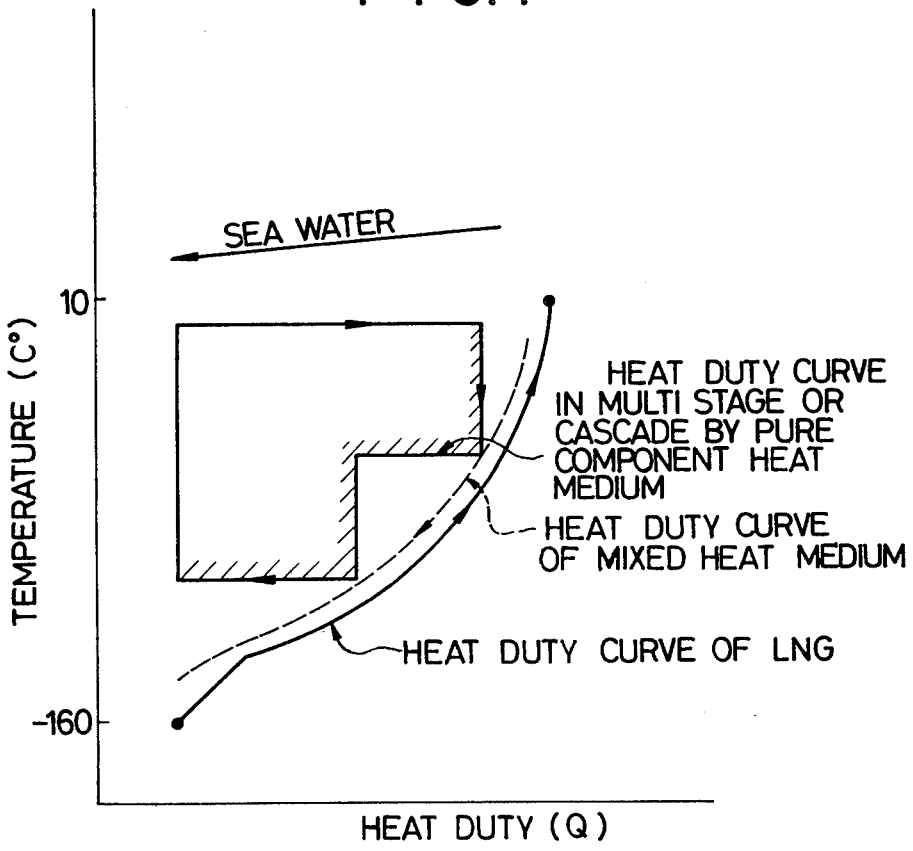
FIG. 1 is a diagram for illustrating the temperature heat duty of the liquefied natural gas which is gasified by using the Rankine cycle of the conventional heat medium having a single component.
Figure 2:
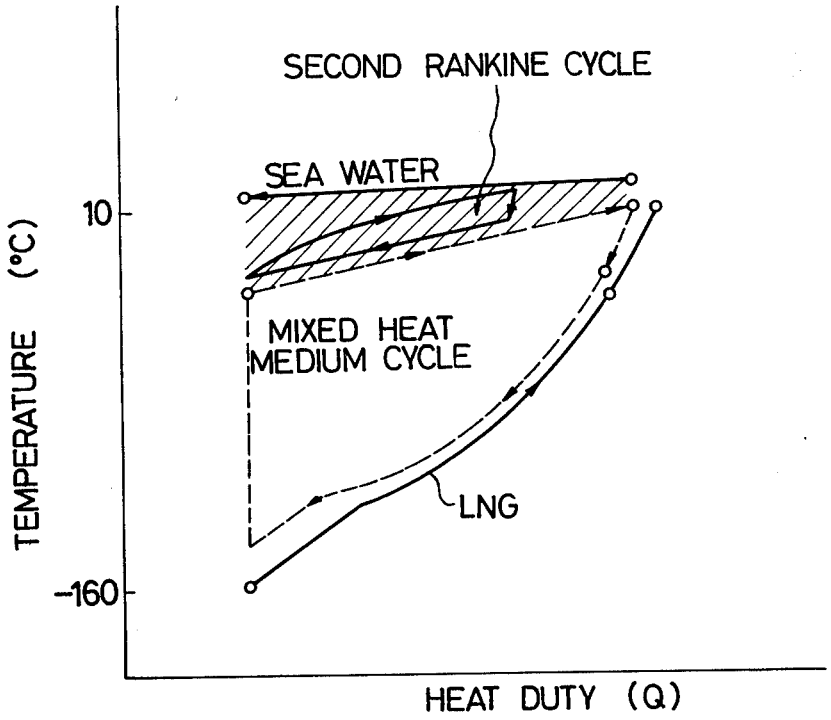
FIG. 2 is a diagram illustrating the temperature-heat duty of liquefied natural gas which is gasified by using the Rankine cycle of a conventional heat medium having mixed components.
Figure 3:
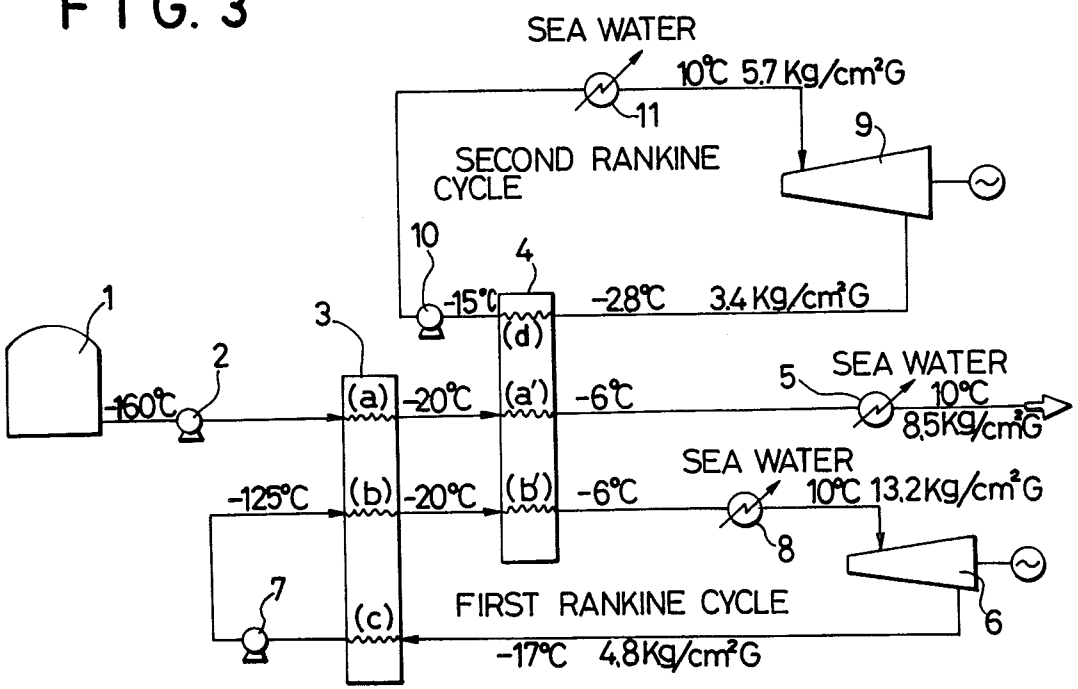
FIG. 3 is a schematic system view of the present invention.

FIG. 3 shows a case in which the rate of the re-gasified natural gas is 100 tons/hour, the pressure is 8.5 Kg/cm$^2$G, the temperature is 10° C., and the temperature of the sea water as the high temperature source is 15° C.

The LNG at a temperature of −160° C. is pressurized and drawn by a pump 2 from a storage tank 1. The LNG in a line (a) of a multi-fluid heat exchanger 3 is heated by exchanging heat with a first mixed heat medium in a line (c), and is gasified at a temperature of −20° C. Further, the LNG is heated in a line (a') of a multi-fluid heat exchanger 4 by exchanging heat with a second mixed heat medium in a line (d), and reaches a temperature of −6° C. After the LNG is heated by sea water at a heat exchanger 5, the LNG is raised to a predetermined temperature and is supplied to the required side. A first medium in this case consists of a mixture of 39.49 mol % of methane, 37.59 sol % of ethane, 16.23 mol % of propane and 6.69 mol % of butane.

The first medium at a pressure of 4.8 Kg/cm$^2$G supplied from a first turbine 6 is supplied to the line (c) of the multi-fluid heat exchanger 3. It is cooled by exchanging heat with the LNG in the line (a) and with a high pressure first medium in a line (b). The first medium is thus completely condensed. The low pressure first medium is pressurized to a pressure of 14 Kg/cm$^2$G by a pump 7 and becomes a high pressure first medium. Further, as has been seen in LNG heating, it is heated in the line (b) of the multi-fluid heat exchanger 3, in a line (b') of the multi-fluid heat exchanger 4, and in a heat exchanger 8 by sea water, and reaches a temperature of 10° C. and is completely gasified. The high pressure gasified first medium is introduced to the first turbine 6 at a pressure of 13.2 Kg/cm$^2$G and its pressure is reduced to 4.8 Kg/cm$^2$. Power in the amount of 6,310 KW is recovered from the high pressure gasified first medium which then becomes the low pressure first medium. Thus, a first Rankine cycle is performed.

On the other hand, a second medium consists of components having a higher boiling point than the first medium. In the embodiment of the present invention, the second medium comprises 5.28 mol % of ethylene and 94.76 mol % of propane. The low pressure second medium discharged from a second turbine 9 is cooled and condensed by heat-exchanging between the line (d) and the line (a') together with the line (b') in the multi-fluid heat exchanger 4. Thus, the low pressure medium is completely liquefied. It is pressurized to 6.5 Kg/cm$^2$G by a pump 10 and becomes the high pressure second medium which is then heated and gasified by the sea water at a heat exchanger 11. The pressure of the completely gasified high presure second medium is reduced in pressure from 5.7 Kg/cm$^2$G to 3.4 Kg/cm$^2$G by a second turbine 9. A power of 480 KW is recovered from expansion of this medium. Thus, the second Rankine cycle is performed.

Figure 4:
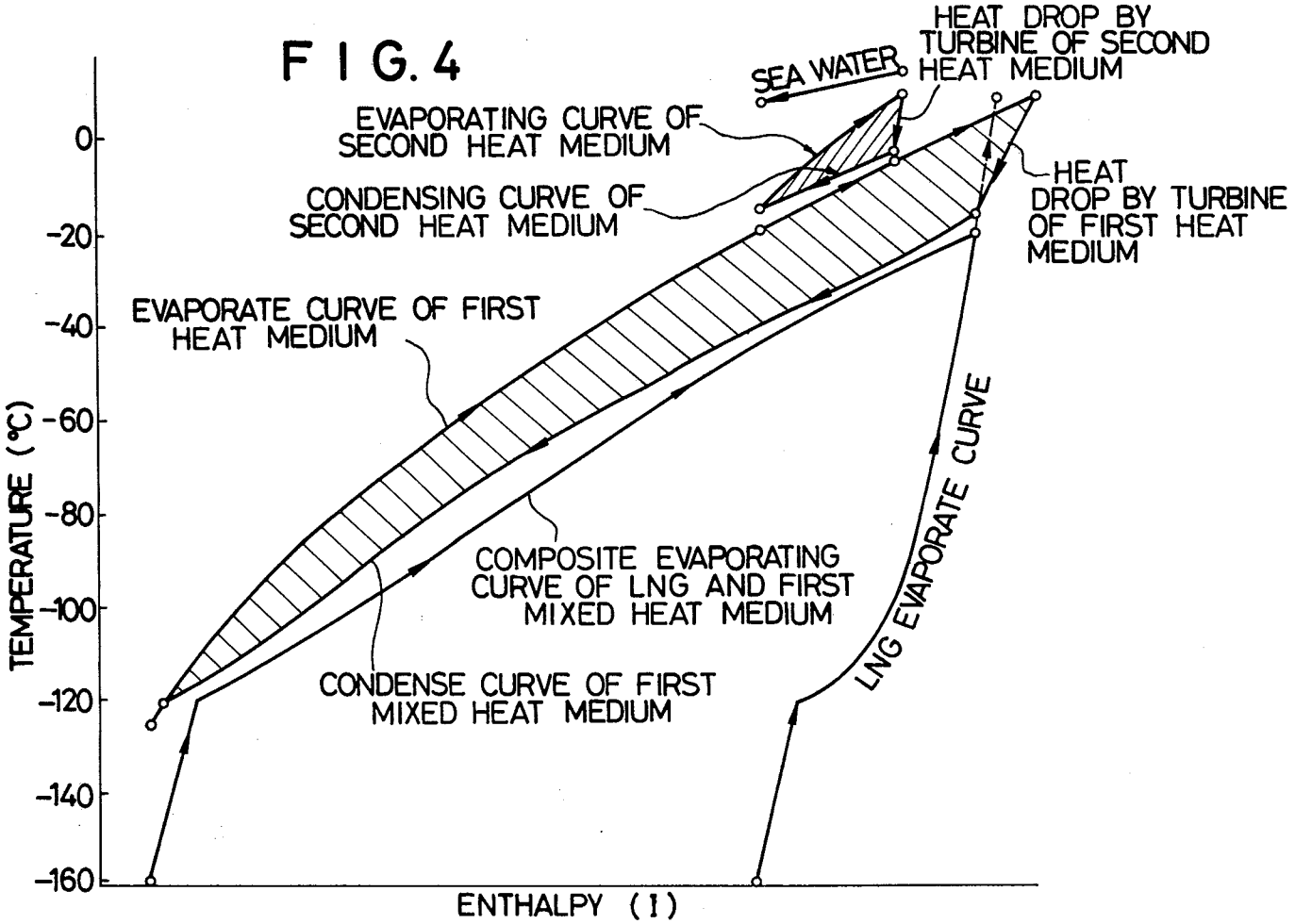
FIG. 4 is a diagram illustrating the temperature-enthalpy dependence of the medium and the natural gas of FIG. 3.

The above example of a cascaded Rankine cycle is illustrated in the temperature-enthalpy diagram of FIG. 4.

In the above embodiment, the sea water at the temperature of 15° C. is shown as a high temperature source fluid. However, according to the present invention, the high temperature source fluid is not restricted to the sea water. For example, higher temperature heating sources such as waste steam can be utilized. In some cases, the system according to the present invention can be operative without including the heat exchangers 5 and 8.

Further, the LNG passing through the multi-fluid heat exchanger 3 can be supplied without passing through the multi-fluid heat exchanger 4.

In summary, a method for recovering power according to a cascaded Rankine cycle in which the liquefied natural gas is gasified and its cold potential is utilized, characterized in that a first medium performs a first Rankine cycle with the liquefied natural gas as the low heat source, a first turbine is disposed to recover a power during the first Rankine cycle, a second medium which has a higher boiling point than the first medium performs a second Rankine cycle with part of the medium of the first Rankine cycle as the low temperature source, the first and second Rankine cycles are cascaded, and a second Rankine is disposed to recover power during the second Rankine cycle. In the first Rankine cycle, the temperature difference between the LNG and the first mixed heat medium is reduced so that the effective energy loss is minimized. The effective energy which is wasted in the heat exchange between the high temperature source and the first mixed heat medium with the first Rankine cycle alone is minimized by the second Rankine cycle. Therefore, maximum power can be recovered by making maximum use of the effective energy as a whole, so that this method contributes to energy saving.

The recovered power without performing the second Rankine cycle is 6,310 KW for LNG supplied at 100 tons/hour. In contrast, the power recovery when the second Rankine cycle is incorporated is 6,790 KW.

According to the present invention, the outlet temperature of the re-gasified natural gas and the first mixed heat medium from the multi-fluid heat exchanger can be raised near ordinary temperature in comparison with the case wherein such a heat exchanger is not used. The requirements for the heat exchanger against frozen sea water are moderated, so that a standard shell and tube type heat exchanger can be used.

What is claimed is:

1. A method for recovering power according to a cascaded Rankine cycle in which liquefied natural gas is gasified and the cold potential thereof is utilized, comprising the steps of selecting a first medium having a low pressure cooling curve substantially corresponding to a vaporizing curve in gasifying the liquefied natural gas as a mixture of hydrocarbons having 1–6 carbon atoms or a mixture of halogenated hydrocarbons of boiling points close to those of said hydrocarbons, using the first medium in a first Rankine cycle with the liquefied natural gas as a low temperature source, exchanging heat of the liquefied natural gas and high pressure first medium with the low pressure first medium in the first Rankine cycle at a first multifluid heat exchanger during the first Rankine cycle, thereby completely condensing said low pressure first medium, vaporizing said liquefied natural gas and vaporizing said high pressure first medium in the first Rankine cycle, using a first pump means to pressurize said condensed first medium to provide said high pressure flat medium between two successive passages of said first medium through said multifluid heat exchanger, using a first turbine for recovering the power generated during the first Rankine cycle, selecting a second medium, having a higher boiling point than said first medium and having a low pressure cooling curve substantially corresponding to a vaporizing curve of said first medium at a high pressure, from the group consisting of a single hyudrocarbon component having 1–6 carbon atoms of a mixture thereof; one or more halogenatedd hydrocarbons having a boiling point close to that of said hydrocarbon components having 1–6 carbon atoms; and ammonia, using said second medium in a second Rankine cycle, cascading said first and second Rankine cycles by using part of said first Rankine cycle as the low temperature source for said second Rankine cycle, exchanging heat of said second medium at a low pressure in the second Rankine cycle with the high pressure first medium after said first multifluid heat exchanger in the first Rankine cycle at a heat exchanger during the cascading of the first and second Rankine cycle, thereby completely condensing said second medium in the second Rankine cycle and further vaporizing said high pressure first medium, using a second pump means to pressurize said condensed second medium, and using a second turbine to recover power during the second Rankine cycle.

2. A method according to claim 1, wherein the first mentioned selecting step comprises the step of selecting said first medium to be said hydrocarbon mixture containing nitrogen or hydrogen or to be halogenated hydrocarbon mixture containing nitrogen.

3. A method according to claim 2 wherein the second mentioned selecting step comprises the step of selecting said second medium to be said hydrocarbon mixture containing nitrogen.

4. A method according to claim 1 wherein said second exchanging step comprises the further step of heating the liquefied natural gas heated in the first Rankine cycle together with the high pressure first medium by heat exchange with the low pressure second medium at said second-mentioned heat exchanger during the cascading of the first and second Rankine cycles.

5. A method according to any one of claims 2, 3, 4 or 1, wherein the liquefied natural gas and the high pressure first medium are both at substantially the same temperature after said first exchanging step.

6. A method according to claim 5, wherein the liquefied natural gas and the high pressure first medium are both at substantially the same temperature after said second exchanging step.

7. A method according to claim 4 wherein the first medium, the liquefied natural gas and the second medium are heated by seawater after said second multifluid heat exchanger during the cascading of the first and second Rankine cycles.

* * * * *